US010758765B2

(12) United States Patent
Smith et al.

(10) Patent No.: US 10,758,765 B2
(45) Date of Patent: Sep. 1, 2020

(54) STATIONARY EXERCISE MACHINE WITH A POWER MEASUREMENT APPARATUS

(71) Applicant: NAUTILUS, INC., Vancouver, WA (US)

(72) Inventors: Joshua S. Smith, Portland, OR (US); Benjamin A. Browning, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 16/296,050

(22) Filed: Mar. 7, 2019

(65) Prior Publication Data

US 2019/0201730 A1 Jul. 4, 2019

Related U.S. Application Data

(63) Continuation of application No. 15/633,689, filed on Jun. 26, 2017, now Pat. No. 10,226,657.
(Continued)

(51) Int. Cl.
*A63B 21/00* (2006.01)
*A63B 22/00* (2006.01)
(Continued)

(52) U.S. Cl.
CPC ..... *A63B 21/00069* (2013.01); *A63B 21/015* (2013.01); *A63B 21/22* (2013.01); *A63B 21/4049* (2015.10); *A63B 22/001* (2013.01); *A63B 22/0056* (2013.01); *A63B 22/0605* (2013.01); *A63B 22/0664* (2013.01); *A63B 21/0051* (2013.01); *A63B 21/0088* (2013.01); *A63B 21/012* (2013.01); *A63B 22/0015* (2013.01); *A63B 22/0017* (2015.10); *A63B 22/06* (2013.01); *A63B 24/0087* (2013.01); *A63B 2022/0676* (2013.01);
(Continued)

(58) Field of Classification Search
CPC ..... A63B 21/00069; A63B 22/0605; A63B 21/4049; A63B 21/22; A63B 21/015; A63B 22/06; A63B 2220/54; A63B 22/0664; A63B 22/001; A63B 22/0056; A63B 2220/805; A63B 21/012; A63B 2071/065; A63B 2071/0652; A63B 2220/24; A63B 2220/51; A63B 21/0051; A63B 21/0088; A63B 22/0015; A63B 24/0087; A63B 2022/0676; A63B 22/0017
See application file for complete search history.

(56) References Cited

U.S. PATENT DOCUMENTS 5,486,923 A 1/1996 Mitchell et al.
5,754,295 A 5/1998 Mitchell et al.
(Continued)

*Primary Examiner* — Andrew S Lo
(74) *Attorney, Agent, or Firm* — Dorsey & Whitney LLP

(57) ABSTRACT

A power measurement apparatus for an exercise machine may include an optical sensing component and a pair of code wheels supported by the frame of the exercise machine. The pair of code wheels may include a first code wheel having a plurality of first windows and a second code wheel having a plurality of second windows that individually at least partially overlap respective ones of the first windows to define respective effective window, the width of which may vary responsive to the application of power via at least one moment-producing assembly. The optical sensing component is operatively associated with the pair of code wheels to detect variations in the width of the effective window and thus measure the power applied via the moment-producing assembly.

17 Claims, 13 Drawing Sheets

Related U.S. Application Data

(60) Provisional application No. 62/440,873, filed on Dec. 30, 2016.

(51) Int. Cl.

| | |
|---|---|
| ***A63B 22/06*** | (2006.01) |
| ***A63B 21/015*** | (2006.01) |
| ***A63B 21/22*** | (2006.01) |
| ***A63B 21/005*** | (2006.01) |
| ***A63B 21/008*** | (2006.01) |
| ***A63B 24/00*** | (2006.01) |
| ***A63B 21/012*** | (2006.01) |
| ***A63B 71/06*** | (2006.01) |

(52) U.S. Cl.

CPC . *A63B 2071/065* (2013.01); *A63B 2071/0652* (2013.01); *A63B 2220/24* (2013.01); *A63B 2220/51* (2013.01); *A63B 2220/54* (2013.01); *A63B 2220/805* (2013.01)

(56) References Cited

U.S. PATENT DOCUMENTS

| | | | |
|---|---|---|---|
| 6,147,674 | A | 11/2000 | Rosenberg et al. |
| 6,356,847 | B1 | 3/2002 | Gerlitzki |
| 9,950,209 | B2 | 4/2018 | Yim et al. |
| 2005/0233871 | A1 | 10/2005 | Anders et al. |
| 2006/0003872 | A1 | 1/2006 | Chiles |
| 2008/0248926 | A1 | 10/2008 | Cole et al. |
| 2009/0011907 | A1 | 1/2009 | Radow et al. |
| 2009/0298649 | A1 | 12/2009 | Dyer et al. |
| 2014/0274575 | A1 | 9/2014 | Yim et al. |
| 2015/0065303 | A1 | 3/2015 | Born |
| 2016/0008658 | A1 | 1/2016 | Yim et al. |

STATIONARY EXERCISE MACHINE WITH A POWER MEASUREMENT APPARATUS

CROSS REFERENCE TO RELATED APPLICATIONS

This application is a continuation of U.S. patent application Ser. No. 15/633,689, filed Jun. 26, 2017, entitled "STATIONARY EXERCISE MACHINE WITH A POWER MEASUREMENT APPARATUS," now issued as U.S. Pat. No. 10,226,657, which claims benefit under 35 U.S.C. § 119 of the earlier filing date of U.S. Provisional Application No. 62/440,873, filed Dec. 30, 2016, entitled "STATIONARY EXERCISE MACHINE WITH A POWER MEASUREMENT APPARATUS," which is hereby incorporated herein by reference in its entirety.

BACKGROUND

Certain stationary exercise machines with reciprocating leg and/or arm portions have been developed. Such stationary exercise machines include stair climbers and elliptical trainers, each of which typically offers a different type of workout. For example, a stair climber may provide a lower frequency vertical climbing simulation while an elliptical trainer may provide a higher frequency horizontal running simulation. Additionally, these machines may include handles that provide support for the user's arms during exercise. However, the connections between the handles and leg portions of traditional stationary exercise machines may not enable sufficient exercise of the user's upper body. Generally, existing stationary exercise machines typically have minimal adjustability mainly limited to adjusting the amount of resistance applied to the reciprocating leg portions. Also, existing stationary machines with both upper and lower inputs (e.g., responsive to leg and arm movements) may not be equipped with means for determining the amount of power generated by one of the upper or lower inputs versus the other. It may therefore be desirable to provide an improved stationary exercise machine which addresses one or more of the problems in the field and which generally improves the user experience.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
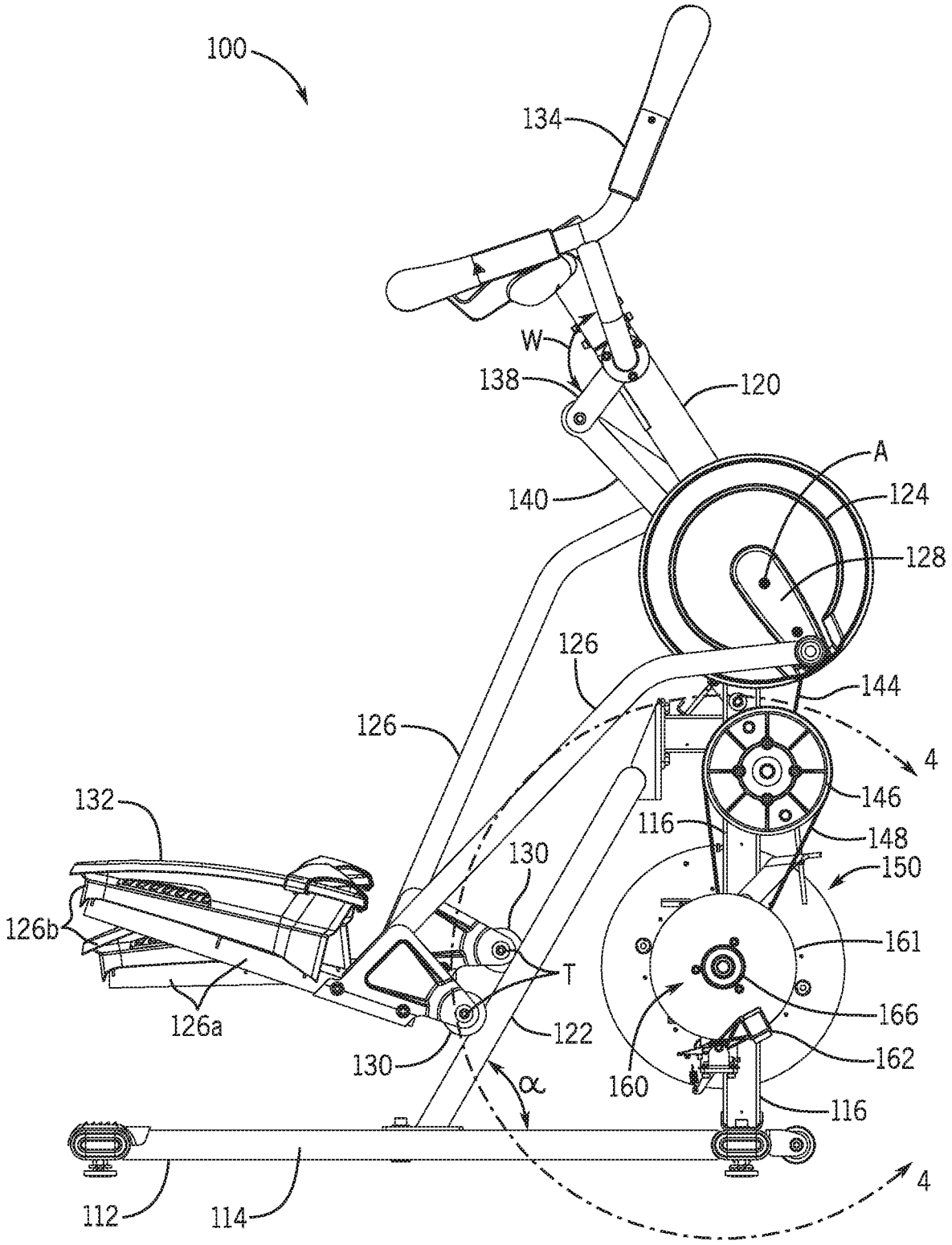
FIG. 1 is a right side view of an exemplary exercise machine.
Figure 2:
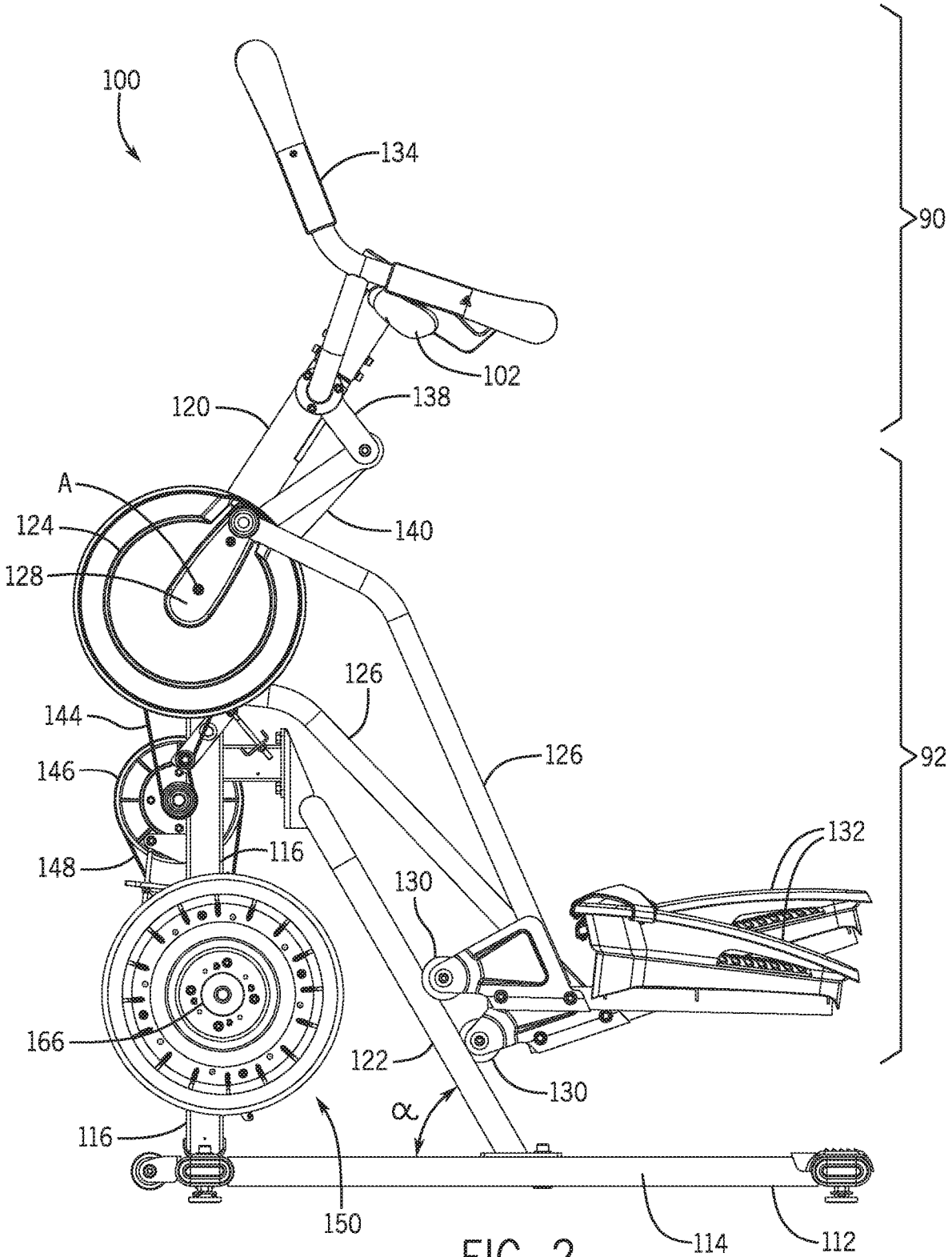
FIG. 2 is a left side view of the machine of FIG. 1.
Figure 3:
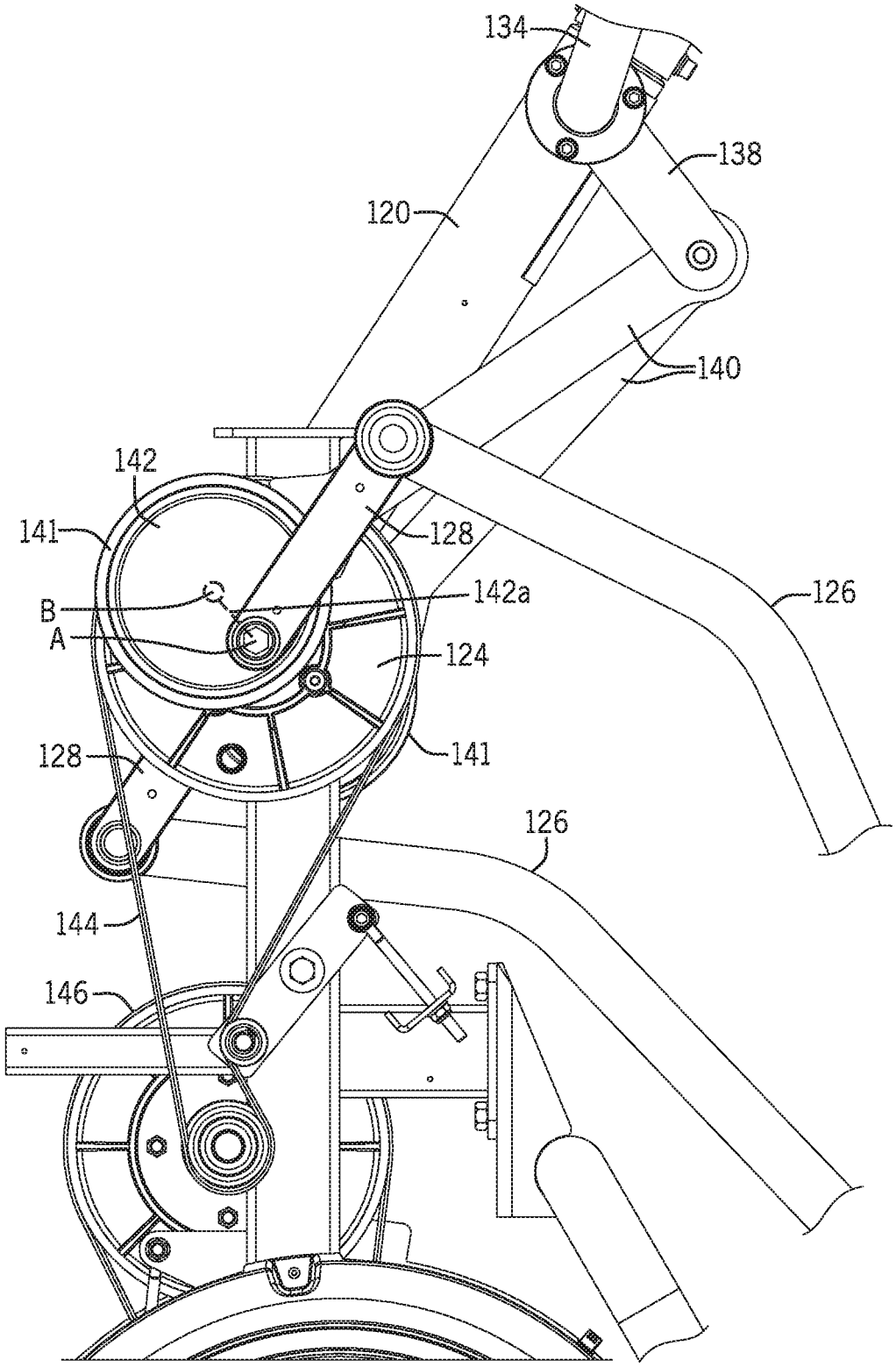
FIG. 3 is a partial view of the machine of FIG. 2.

Described herein are embodiments of stationary exercise machines having reciprocating foot and/or hand members, such as foot pedals that move in a closed loop path. The disclosed machines can provide variable resistance against the reciprocal motion of a user, such as to provide for variable-intensity interval training. Some embodiments can comprise reciprocating foot pedals that cause a user's feet to move along a closed loop path that is substantially inclined, such that the foot motion simulates a climbing motion more than a flat walking or running motion. Some embodiments can further comprise reciprocating hand members that are configured to move in coordination with the foot pedals and allow the user to exercise the upper body muscles. Variable resistance can be provided via a rotating air-resistance based fan-like mechanism, via a magnetism based eddy current mechanism, via friction based brakes, and/or via other mechanisms, one or more of which can be rapidly adjustable while the user is using the machine to provide variable intensity interval training.

FIGS. 1-7 show an embodiment of an exercise machine 100. The machine 100 includes a frame 112, which includes a base 114 for contact with a support surface, a vertical brace 116 extending from the base 114 to an upper support structure 120, and first and second inclined members 122 that extend between the base 114 and the vertical brace 116. The various components shown in FIGS. 1-7 are merely illustrative, and other variations, including eliminating components, combining components, rearranging components, and substituting components are all contemplated.

The machine 100 may include an upper moment-producing mechanism and a lower moment producing mechanism. The upper moment-producing mechanism and the lower moment producing mechanism may each provide an input into a crankshaft 125 (see e.g., FIGS. 2 and 7) inducing a tendency for the crankshaft 125 to rotate about axis A. Each of the upper and lower moment-producing mechanisms may include one or more links operatively connected into a linkage that produces the moment on the crankshaft 125. For example, the upper moment-producing mechanism may include one or more upper links extending from the handles 134 to the crankshaft 125. The lower moment-producing mechanism may include one or more lower links extending from the pedal 132 to crankshaft 125. In one example, the machine may include left and right upper linkages 90, each including a plurality of links configured to connect an input end (e.g., a handle end) of the upper linkage to the crankshaft 125. Likewise, the machine may include left and right lower linkages 92, each including a plurality of links configured to connect an input end (e.g., a pedal end) of the lower linkage to the crankshaft 125. The crankshaft 125 may have a first side and a second side and may be rotatable about the crankshaft axis A. The first side of the crankshaft 125 may be connected e.g., to the left upper and lower linkages, and the second side of the crankshaft 125 may be connected e.g., to the right upper and lower linkages.

In various embodiments, the lower moment-producing mechanism may include a first lower linkage 92 and a second lower linkage 92 corresponding to a left and right side of machine 100. Each of the first and second lower linkages may include one or more links operatively arranged to transform a force input from the user (e.g., from the lower body of the user) into a moment about the crankshaft 125. For example, the first and second lower linkages may include one or more of first and second pedals 132, first and second rollers 130, first and second lower reciprocating members 126 (also referred to as foot members 126), and/or first and second crank arms 128, respectively. The first and second lower linkages may operably transmit a force input from the user into a moment about the crankshaft 125.

The first and second crank arms 128 are fixed relative to the respective side of the crankshaft 125. The machine 100 may optionally include first and/or second crank wheels 124 which may be rotatably supported on opposite sides of the upper support structure 120 about a horizontal rotation axis A. The crank arms 128 may be positioned on outer sides of the crank wheels 124 and may be fixed relative to the respective first and second crank wheels 124. The crank arms 128 may be rotatable about the rotation axis A, such that rotation of the crank arms 128 causes the crankshaft 125 and/or crank wheels 124 to rotate. The first and second crank arms 128 extend from the crankshaft 125 (e.g., from the axis A) in opposite radial directions to their respective radial ends. For example, the first side and the second side of the crank shaft 125 may be fixedly connected to the output ends of the first and second crank arms 128 and the input ends of each crank arm may extend radially from the connection between the crank arm and the crank shaft. First and second lower reciprocating members 126 may have forward ends (i.e., output ends) that are pivotably coupled to the radial ends (i.e., input ends) of the first and second crank arms 128, respectively. The terms pivotably and pivotally are used interchangeably herein. The rearward ends (i.e., input ends) of the first and second lower reciprocating members 126 may be coupled to first and second foot pedals 132, respectively. The rearward ends (i.e., input ends) of the first and second lower reciprocating members 126 may thus be interchangeably referred to as pedal ends.

First and second rollers 130 may be coupled to the first and second lower reciprocating members 126, respectively, for example to or proximate the pedal ends or to an intermediate location. In various examples, the first and second rollers 130 may be connected to the pedals, e.g., the first and second pedals 132 may each have first ends with first and second rollers 130, respectively, extending therefrom. Each of the first and second pedals 132 may have second ends with first and second platforms 126*b* (or similarly pads), respectively. First and second brackets 126*a* may form the portion of the first and second pedals 132 which connects the first and second platforms 132*b* and the first and second brackets 132*a*. The first and second lower reciprocating members 126 may be fixedly connected to the first and second brackets 126*a* between the first and second rollers 130, respectively, and the first and second platforms 132*b*, respectively. The connection may be closer to a front of the first and second platform than the first and second rollers 130. The first and second platforms 132*b* may be operable for a user to stand on and provide an input force. The first and second rollers 130 rotate about individual roller axes T. The first and second rollers may rotate on and travel along first and second inclined members 122, respectively. The first and second inclined members 122 may form a travel path along the length and height of the first and second incline members. The rollers 130 can rollingly translate along the inclined members 122 of the frame 112. In alternative embodiments, other bearing mechanisms can be used to provide translational motion of the lower reciprocating members 126 along the inclined members 122 instead of or in addition to the rollers 130, such as sliding friction-type bearings.

When the foot pedals 132 are driven by a user, the pedal ends of the reciprocating members 126 (also referred to as foot members 126) translate in a substantially linear path via the rollers 130 along the inclined members 122. In alternative embodiments, the inclined members can comprise a non-linear portion, such as a curved or bowed portion, such that pedal ends of the foot members 126 translate in non-linear path via the rollers 130 along the non-linear portion of the inclined members. The non-linear portion of the inclined members can have any curvature, such as a curvature of a constant or non-constant radius, and can present convex, concave, and/or partially linear surfaces for the rollers to travel along. In some embodiments, the non-linear portion of the inclined members 122 can have an average angle of inclination of at least 45°, and/or can have a minimum angle of inclination of at least 45°, relative to a horizontal ground plane.

The output ends of the foot members 126 move in circular paths about the rotation axis A, which drives the crank arms 128 and/or the crank wheels 124 in a rotational motion about axis A. The circular movement of the output ends of the foot members 126 causes the pedal ends to pivot at the roller axis D as the rollers (and thereby roller axis D) translates along the inclined members 122. The combination of the circular motion of the output ends, the linear motion of the pedal ends, and pivotal action about the axis D, causes the pedals 132 to move in non-circular closed loop paths, such as substantially ovular and/or substantially elliptical closed loop paths. The closed loop paths traversed by different points on the foot pedals 132 can have different shapes and sizes, such as with the more rearward portions of the pedals 132 traversing longer distances. A closed loop path traversed by the foot pedals 132 can have a major axis defined by the two points of the path that are furthest apart. The major axis of one or more of the closed loop paths traversed by the pedals 132 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 114. To cause such inclination of the closed loop paths of the pedals 132, the inclined members 122 can comprise a substantially linear portion over which the rollers 130 traverse. The inclined members 122 form a large angle of inclination a relative to the horizontal base 114, such as at least 45°, at least 50°, at least 55°, at least 60°, at least 65°, at least 70°, at least 75°, at least 80°, and/or at least 85°. This large angle of inclination which sets the path for the foot pedal motion can provide the user with a lower body exercise more akin to climbing than to walking or running on a level surface. Such a lower body exercise can be similar to that provided by a traditional stair climbing machine.

In various embodiments, the upper moment-producing mechanism may include a first upper linkage 90 and a second upper linkage 90 corresponding to a left and right side of machine 100. Each of the first and second upper linkages may include one or more links operatively arranged to transform a force input from the user (e.g., from the upper body of the user) into a moment about the crankshaft 125. For example the first and second upper linkages may include one or more of first and second handles 134, first and second links 138, first and second upper reciprocating members 140 (also referred to herein as hand member 140), and/or first and second virtual crank arms 142*a*, respectively. The first and second upper linkages may operably transmit a force input from the user, at the handles 134, into a moment about the crankshaft 125. The first and second handles 134 may be pivotally coupled to the upper support structure 120 at a horizontal axis D.

The handles 134 may be rigidly connected to the input end of respective first and second links 138 such that reciprocating pivotal movement of the handles 134 about the horizontal axis D causes corresponding reciprocating pivotal movement of the first and second links 138 about the horizontal axis D.

For example, the first and second links 138 may be cantilevered off of handles 134 at the pivot aligned with the D axis. Each of the first and second links 138 may have angle ω with the respective handles 134. The angle ω may be measured from a plane passing through the axis D and the curve in the handle proximate the connection to the link 138. The angle ω may be any angle such as angles between 0 and 180 degrees. The angle ω may be optimized to one that is most comfortable to a single user or an average user. The links 138 are pivotably coupled at their radial ends (i.e., output ends) to first and second reciprocating hand members 140. The lower ends of the hand members 140 may include respective circular disks 142 (see e.g., FIG. 3) which are rotatable relative to the rest of the hand member 140 about respective disk axes B. The disk axes B, which are located at the center of each disk 142, are parallel to the rotation axis A. The disk axes B of the disks 142 positioned on opposite sides of the crank shaft 125 are offset radially in opposite directions from the axis A. Virtual crank arms 142*a* may thus be defined between the centers of the circular disks 142 (i.e., between axes B) and the rotation axis A.

The lower ends of the upper reciprocating members 140 may be pivotably connected to the first and second virtual crank arms 142*a* (see FIG. 3), respectively. The first and second virtual crank arms 142*a* may be rotatable relative to the rest of the upper reciprocating members 140 about respective axes B (which may be referred to as virtual crank arm axes). Axes B may be parallel to the crank axis A. Each axis B may be located proximal to an end of each of the upper reciprocating members 140. Each axis B may also be located proximal to one end of the virtual crank arm 142*a*. Each axis B may be offset radially in opposite directions from the axis A. Each respective virtual crank arm 142*a* may be perpendicular to axis A and each of the axes B, respectively. The distance between axis A and each axis B may define approximately the length of the virtual crank arm. This distance between axis A and each axis B is also the length of the moment arm of each virtual crank arm 142*a* which exerts a moment on the crankshaft. As used herein, the virtual crank arm 142*a* may be any device which exerts a moment on the crankshaft 125. For example, as used above, the virtual crank arm 142*a* may be the disk 142 (e.g., the distance between the center of the disk 142 and the radial location on disk 142 through which axis A passes. In another example, the virtual crank arm 142*a* may be a crank arm similar to crank arm 128. Each of the virtual crank arms may be a single length of semi-rigid to rigid material having pivots proximal to each end with one of the reciprocating members pivotably connected along axis B proximal to one end and the crankshaft fixedly connected along axis A proximally connected to the other end. The virtual crank arm may include more than two pivots and have any shape. As discussed hereafter, the virtual crank arm is described as being disk 142 but this is merely as an example, as the virtual crank arm may take any form operable to apply a moment to crankshaft 125. As such, each embodiment including the disk may also include the virtual crank arm or any other embodiment disk herein or would be understood by one of ordinary skill in the art as applicable.

The links 138 are pivotably coupled at their radial ends (i.e., output ends) to first and second upper reciprocating members 140. The links 138 and upper reciprocating members 140 are pivotally coupled at respective pivots coaxial with axes C. The lower ends of the upper reciprocating members 140 include respective annular collars 141 and respective circular discs 142, each rotatable within the respective collar. As such, the respective circular disks 142 are rotatable relative to the rest of the upper reciprocating member 140 about respective disk axes B. The disk axes B are parallel to the rotation axis A and offset radially in opposite directions from the axis A.

As the handles 134 articulate back and forth (i.e., reciprocate pivotally about axis D), the links 138 move in corresponding arcs, which in turn articulates the upper reciprocating members 140. Via the fixed connection between the upper reciprocating member 140 and annular collar 141, the articulation of handle 134 also moves annular collar 141. As rotatable disk 142 is fixedly connected to and rotatable around the crankshaft which pivots about axis A, rotatable disk 142 also rotates about axis A. As the upper reciprocating member 140 articulates back and forth it forces the annular collar 141 toward and away from the axis A along a circular path with the result of causing axis B and/or the center of disk 142 to circularly orbit around axis A. As the crank arms 128 and/or crank wheels 124 rotate about the axis A, the disk axes B orbit about the axis A. The disks 142 are also pivotably coupled to the crank axis A, such that the disks 142 rotate within the respective lower ends of the upper reciprocating members 140 as the disks 142 pivot about the crank axis A on opposite sides of the upper support member 120. The disks 142 can be fixed relative to the respective crank arms 128, such that they rotate in unison around the crank axis A when the pedals 132 and/or the handles 134 are driven by a user.

Figure 10:
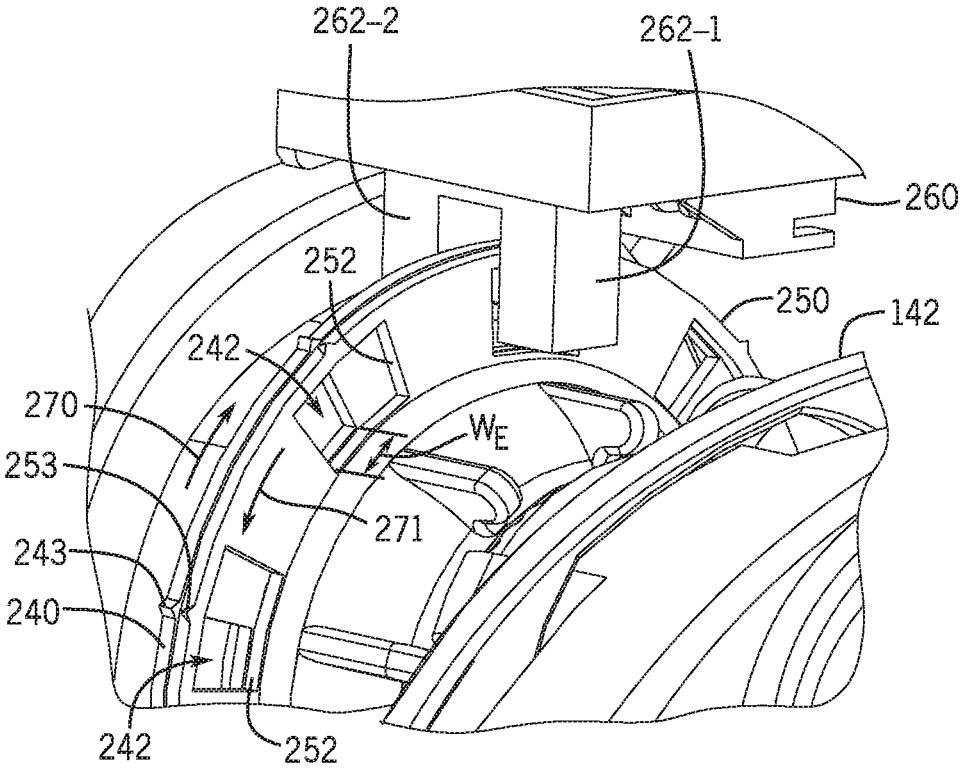
FIG. 10 is a partial perspective view of components of the measurement apparatus of FIG. 9.
Figure 11:
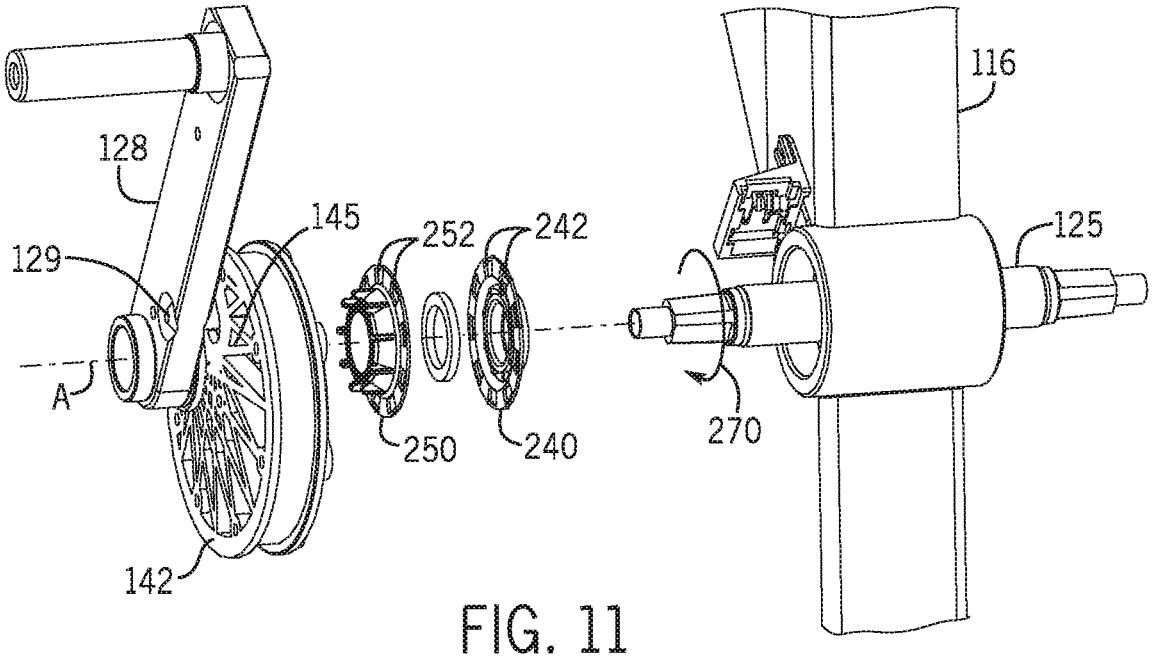
FIG. 11 is an exploded view of the measurement apparatus of FIG. 9.

The upper linkage assemblies may be configured in accordance with the examples herein to cause the handles 134 to reciprocate in opposition to the pedals 132 such as to mimic the kinematics of natural human motion. For example, as the left pedal 132 is moving upward and forward, the left handle 134 pivots rearward, and vice versa. As shown in FIG. 10, the machine 100 can further comprise a user interface 102 mounted near the top of the upper support member 120. The user interface 102 can comprise a display to provide information to the user, and can comprise user inputs to allow the user to enter information and to adjust settings of the machine, such as to adjust the resistance. The machine 100 can further comprise stationary handles 104 mounted near the top of the upper support member 120.

The exercise machine 100 may include a resistance mechanism operatively arranged to resist the rotation of the crankshaft. In some embodiments, the exercise machine may include one or more resistance mechanism such as an air-resistance based resistance mechanism, a magnetism based resistance mechanism, a friction based resistance mechanism, and/or other resistance mechanisms.

For example, resistance may be applied via an air brake, a friction brake, a magnetic brake or the like. The machine 100 may include an air-resistance based resistance mechanism, or air brake 150, that is rotationally mounted to the frame 112 on a horizontal shaft 166. The machine 100 may additionally or alternatively include a magnetic-resistance based resistance mechanism, or magnetic brake 160 (see e.g., FIGS. 1 and 4), which includes a rotor 161 rotationally mounted to the frame 112 and a brake caliper 162 also mounted to the frame 112. The rotor 161 and the air brake 150 may be coupled to the same horizontal shaft (e.g., shaft 166). The air brake 150 and rotor 161 are driven by the rotation of the crankshaft 125 and are each operable to resist the rotation of the crankshaft 125. In the illustrated embodiment, the shaft 166 is driven by a belt or chain 148 that is coupled to a pulley 146. Pulley 146 is coupled to another pulley 125 mounted coaxially with the axis A by another belt or chain 144. The pulleys 125 and 146 can be used as a gearing mechanism to set the ratio of the angular velocity of the air brake 150 and the rotor 161 relative to the reciprocation frequency of the pedals 132.

One or more of the resistance mechanisms can be adjustable to provide different levels of resistance at a given reciprocation frequency. Further, one or more of the resistance mechanisms can provide a variable resistance that corresponds to the reciprocation frequency of the exercise machine, such that resistance increases as reciprocation frequency increases. For example, one reciprocation of the pedals 132 can cause several rotations of the air brake 150 and rotor 161 to increase the resistance provided by the air brake 150 and/or the magnetic brake 160. The air brake 150 can be adjustable to control the volume of air flow that is induced to flow through the air brake at a given angular velocity in order to vary the resistance provided by the air brake.

Figure 4:
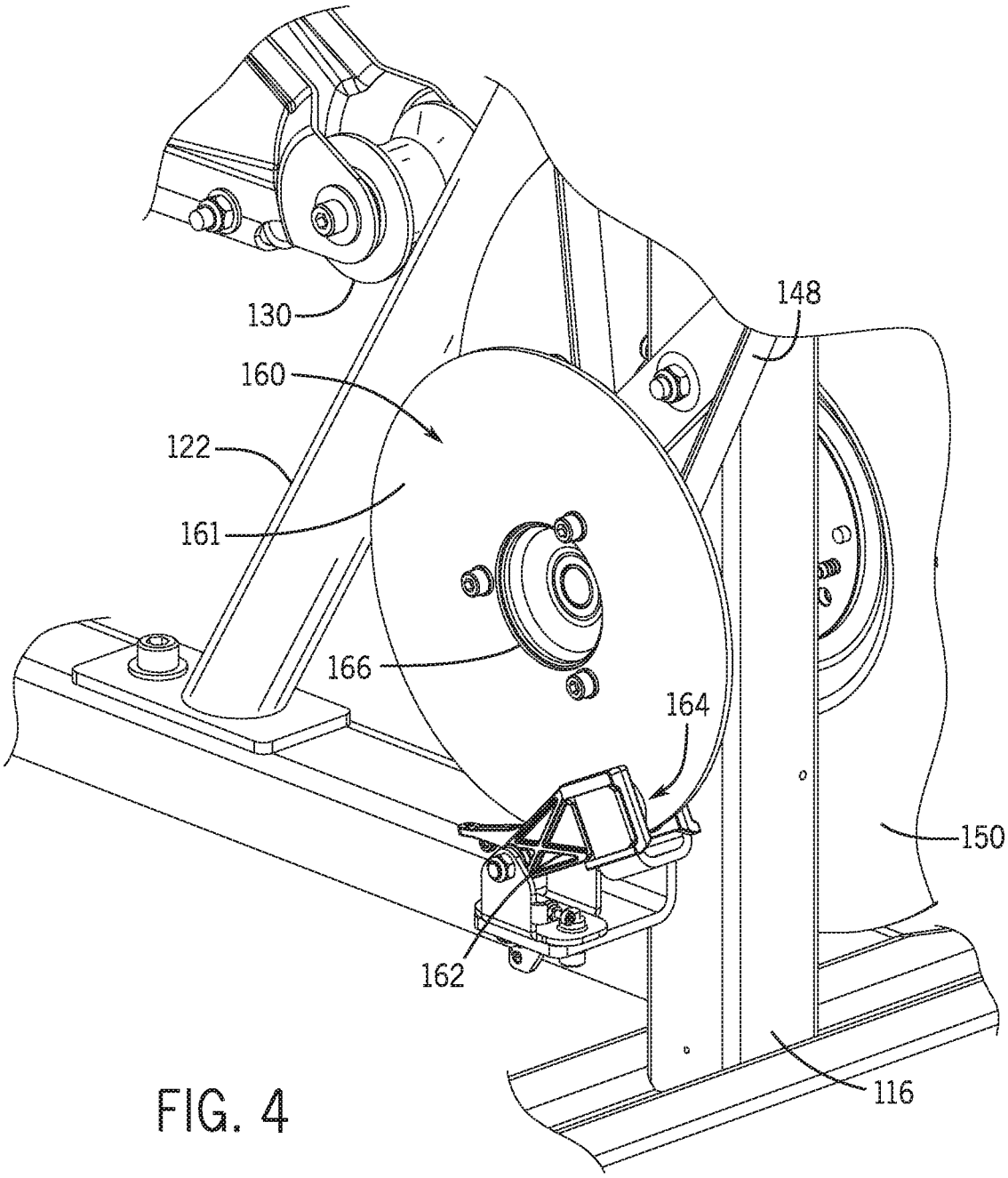
FIG. 4 is a perspective view of a magnetic brake of the machine of FIG. 1.

The magnetic brake 160 provides resistance by magnetically inducing eddy currents in the rotor 161 as the rotor rotates. As shown in FIG. 4, the brake caliper 162 includes high power magnets 164 positioned on opposite sides of the rotor 161. As the rotor 161 rotates between the magnets 164, the magnetic fields created by the magnets induce eddy currents in the rotor, producing resistance to the rotation of the rotor. The magnitude of the resistance to rotation of the rotor can increase as a function of the angular velocity of the rotor, such that higher resistance is provided at high reciprocation frequencies of the pedals 132 and handles 134. The magnitude of resistance provided by the magnetic brake 160 can also be a function of the radial distance from the magnets 164 to the rotation axis of the shaft 166. As this radius increases, the linear velocity of the portion of the rotor 161 passing between the magnets 164 increases at any given angular velocity of the rotor, as the linear velocity at a point on the rotor is a product of the angular velocity of the rotor and the radius of that point from the rotation axis. In some embodiments, the brake caliper 162 can be pivotably mounted, or otherwise adjustable mounted, to the frame 116 such that the radial position of the magnets 134 relative to the axis of the shaft 166 can be adjusted. For example, the machine 100 can include a motor coupled to the brake caliper 162 that is configured to move the magnets 164 to different radial positions relative to the rotor 161. As the magnets 164 are adjusted radially inwardly, the linear velocity of the portion of the rotor 161 passing between the magnets decreases, at a given angular velocity of the rotor, thereby decreasing the resistance provided by the magnetic brake 160 at a given reciprocation frequency of the pedals 132 and handles 134. Conversely, as the magnets 164 are adjusted radially outwardly, the linear velocity of the portion of the rotor 161 passing between the magnets increases, at a given angular velocity of the rotor, thereby increasing the resistance provided by the magnetic brake 160 at a given reciprocation frequency of the pedals 132 and handles 134.

In some embodiments, the brake caliper 162 can be adjusted rapidly while the machine 10 is being used for exercise to adjust the resistance. For example, the radial position of the magnets 164 of the brake caliper 162 relative to the rotor 161 can be rapidly adjusted by the user while the user is driving the reciprocation of the pedals 132 and/or handles 134, such as by manipulating a manual lever, a button, or other mechanism positioned within reach of the user's hands (see e.g., FIGS. 2 and 3) while the user is driving the pedals 132 with his feet. Such an adjustment mechanism can be mechanically and/or electrically coupled to the magnetic brake 160 to cause an adjustment of eddy currents in the rotor and thus adjust the magnetic resistance level. The user interface 102 can include a display to provide information to the user, and can include user inputs to allow the user to enter to adjust settings of the machine, such as to adjust the resistance. In some embodiments, such a user-caused adjustment can be automated, such as using a button on the user interface 102 that is electrically coupled to a controller and an electrical motor coupled to the brake caliper 162. In other embodiments, such an adjustment mechanism can be entirely manually operated, or a combination of manual and automated. In some embodiments, a user can cause a desired magnetic resistance adjustment to be fully enacted in a relatively short time frame, such as within a half-second, within one second, within two seconds, within three second, within four seconds, and/or within five seconds from the time of manual input by the user via an electronic input device or manual actuation of a mechanical device. In other embodiments, the magnetic resistance adjustment time periods can be smaller or greater than the exemplary time periods provided above.

Figure 5:
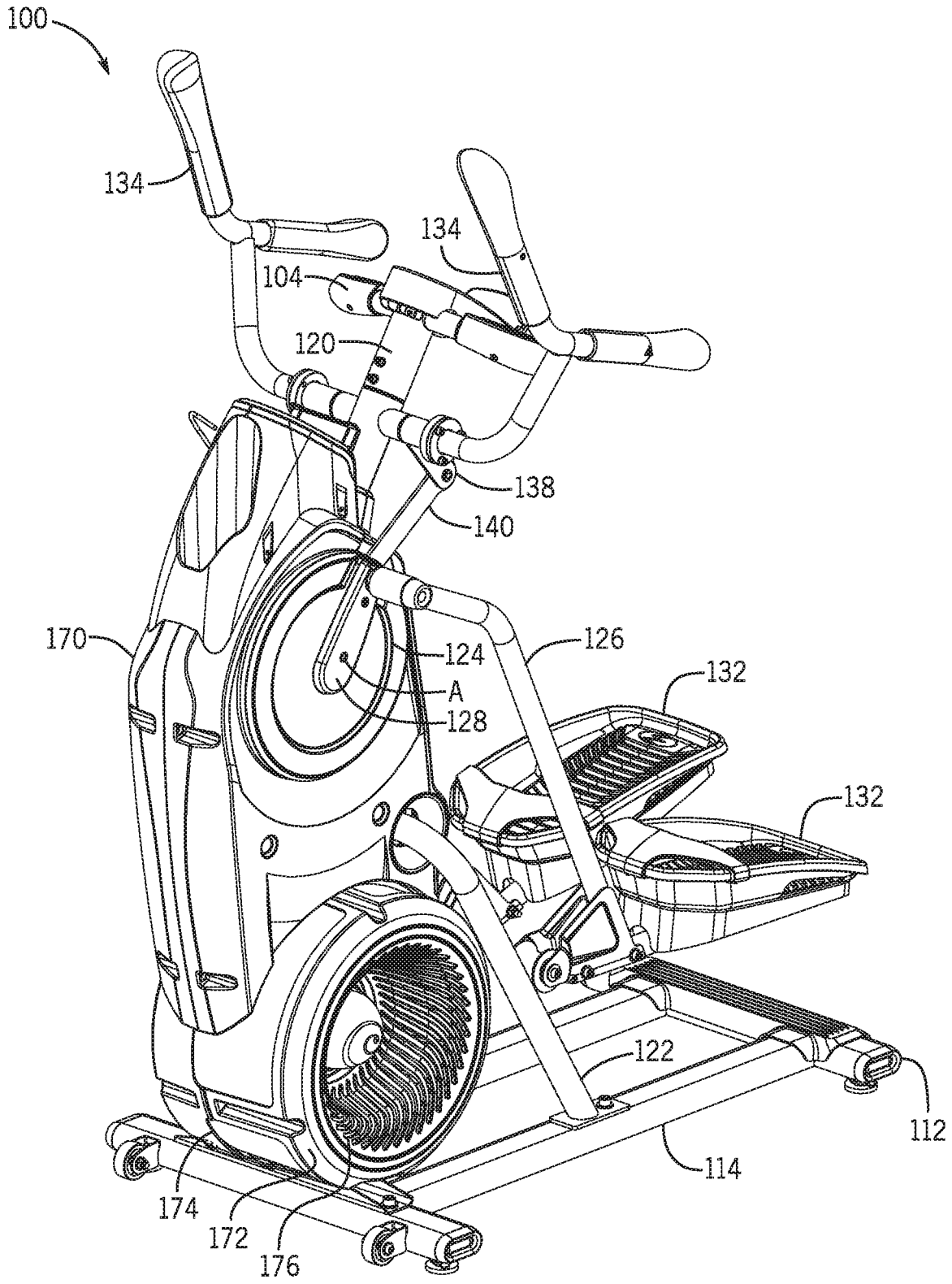
FIG. 5 is a perspective view of an embodiment of the machine of FIG. 1 with an outer housing included.
Figure 6:
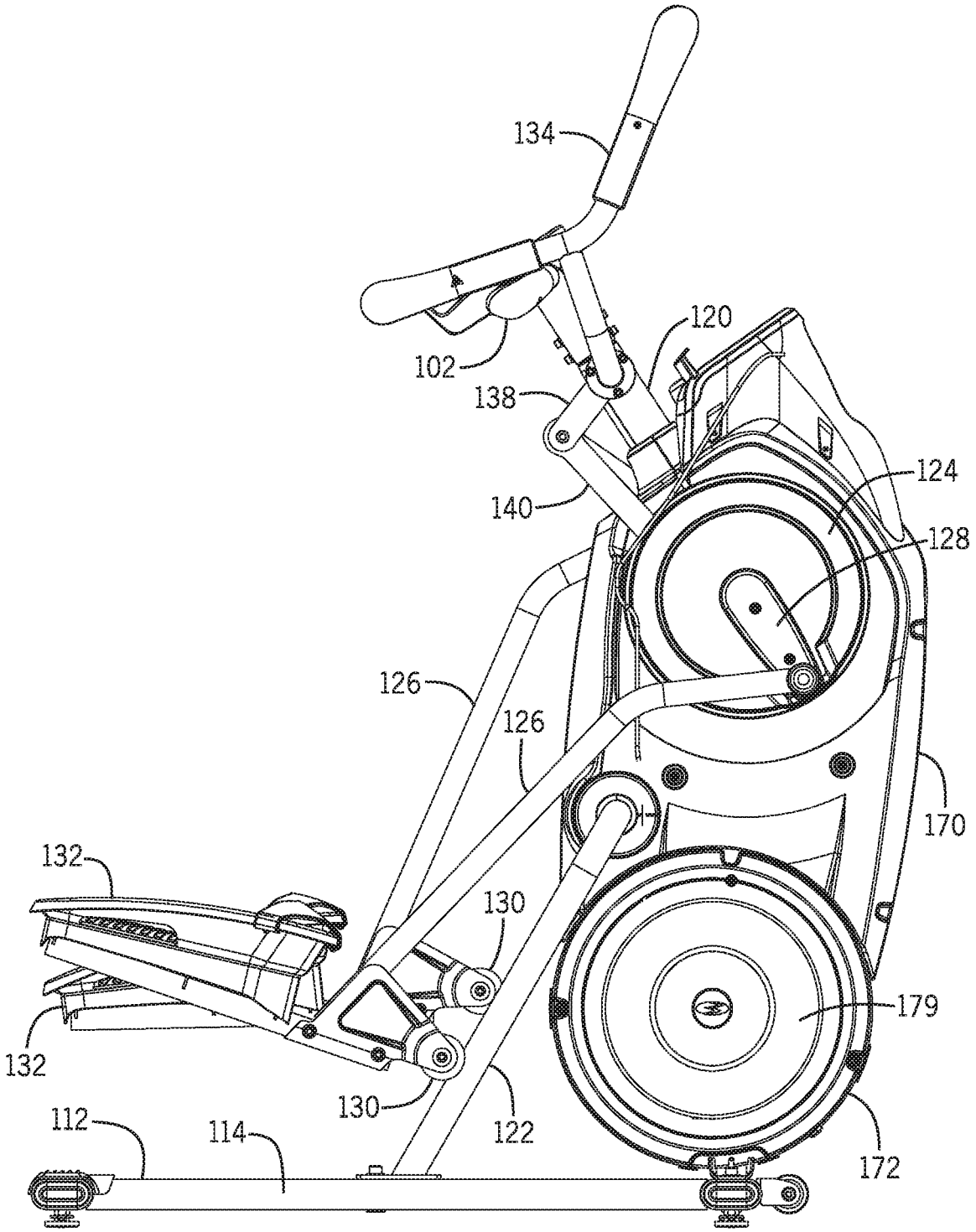
FIG. 6 is a right side view of the machine of FIG. 5.
Figure 7:
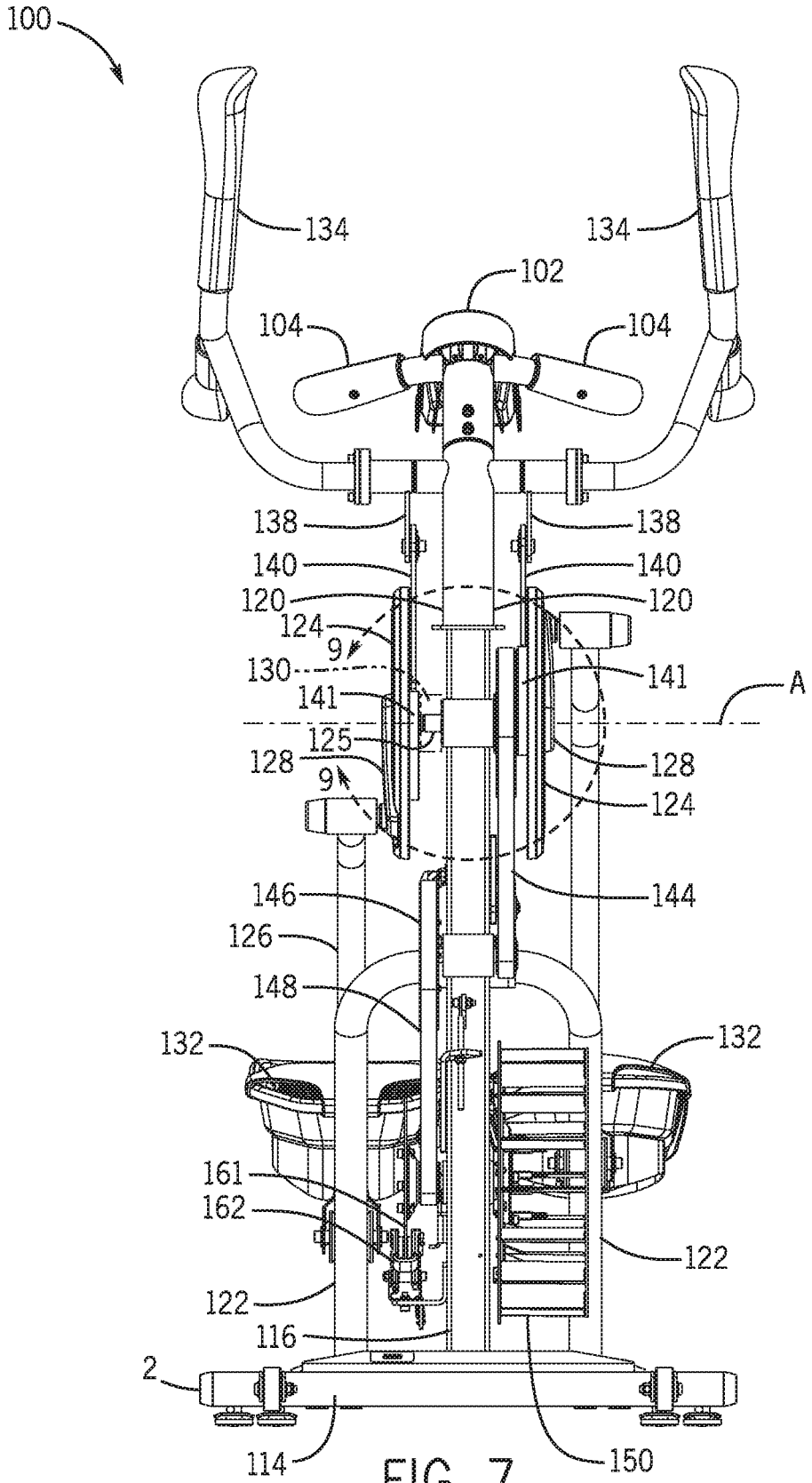
FIG. 7 is a front view of the machine of FIG. 1.
Figure 8:
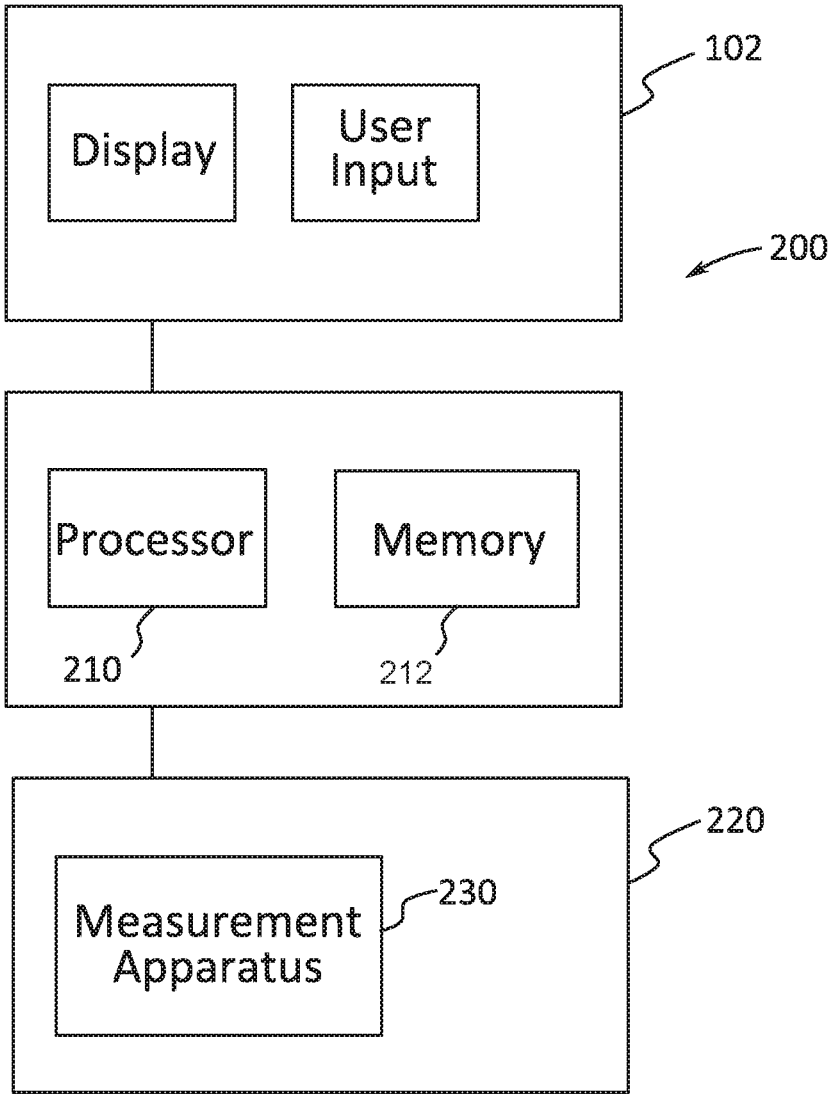
FIG. 8 is a block diagram of an energy tracking system for an exercise machine such as the machine of FIG. 1.

FIGS. 5 and 6 show an embodiment of the exercise machine 100 with an outer housing 170 mounted around a front portion of the machine. The housing 170 can house and protect portions of the frame 112, the pulleys 125 and 146, the belts or chains 144 and 148, lower portions of the upper reciprocating members 140, the air brake 150, the magnetic brake 160, motors for adjusting the air brake and/or magnetic brake, wiring, and/or other components of the machine 100. The housing 170 can include an air brake enclosure 172 that includes lateral inlet openings 176 to allow air into the air brake 150 and radial outlet openings 174 to allow air out of the air brake. The housing 170 can further include a magnetic brake enclosure 179 to protect the magnetic brake 160, where the magnetic brake is included in addition to or instead of the air brake 150. The crank arms 128 and/or crank wheels 124 can be exposed through the housing such that the lower reciprocating members 126 can drive them in a circular motion about the axis A without obstruction by the housing 170.

A stationary exercise machine in accordance with some examples herein may include a frame, a crankshaft rotatably supported by the frame, an upper moment-producing mechanism and a lower moment-producing mechanism both operatively engaged to the crankshaft to cause the crankshaft to rotate. In some examples, the lower moment producing mechanism includes at least one crank arm coupled to the crankshaft to cause rotation of the crankshaft responsive to rotation of the crank arm. In some examples, the upper moment producing mechanism may include at least one link coupled to the crankshaft to also cause rotation of the crankshaft responsive to movement of the link. In some examples, the link may be a rigid link, such as a straight bar member, or a portion of a rotating disk, or a plurality of links operatively coupled to the crankshaft to cause it to rotate. The link may also be referred to as a virtual crank arm. The lower moment-producing mechanism and the upper moment-producing mechanism may be resiliently coupled to one another, such as via a resilient coupling between the crank arm of the lower moment-producing mechanism and the link or virtual crank arm or the upper moment-producing mechanism. In some examples, herein, the stationary exercise machine may further include a measurement apparatus which may be configured to measure differential forces between the upper and lower mechanisms. The measurement apparatus may employ one or more optical sensing components, strain gauges, load cells, etc. for measuring the applied force via the upper moment-producing mechanism and independently and/or relatively via the lower moment-producing mechanism. In one embodiment, the measurement apparatus may include an optical sensor operatively arranged with a pair of code wheels to detect a relative displacement between the two code wheels. In some examples, the first code wheel may be coupled such that it rotates synchronously with the crank arm of the lower moment-producing mechanism. For example, the first code wheel may be rigidly coupled to the crank shaft and/or the crank arm of the lower moment-producing mechanism. The second code wheel may be coupled such that it rotates synchronously with the virtual crank arm, e.g., by being rigidly or otherwise operatively coupled to the virtual crank arm. The two code wheels may be movable relative to one another to allow a relative displacement between the code wheels responsive to application of force via both of the upper and lower moment-producing mechanisms. In some examples, the code wheels may be coaxially coupled to one another and rotatable about the crank shaft axis.

Referring now also to FIGS. 8-14, in accordance with some examples herein, the exercise machine 100 may include an energy tracking system 200, which may be configured to provide information to the user, for example including in whole or in part the energy or power generated by the user during exercise. The energy tracking system 200 may include a processing circuit 210 and a memory 212. The energy tracking system 200 may be operatively (e.g., communicatively) coupled to the user interface 102 for displaying information to the user (e.g., resistance level, energy or power generated by the user, calories burned, etc.) and/or receiving input from the user (e.g., weight of the user). The energy tracking system 200 may receive as input signals from one or more measurement apparatuses 220, which may be operatively coupled with moving components of the exercise machine 100. For example, the energy tracking system 200 may be operatively coupled with one or more load sensors, strain gauges, or the like, to measure the torque applied to the crankshaft 125. The torque and the angular displacement of the crankshaft 125 can be used to calculate the work and thus the power applied to the crankshaft 125, which is indicative of the power generated by the user during exercise. The angular displacement can be measured using an angular position sensor such as a rotary encoder (e.g., an optical incremental encoder) or it can be obtained from measurements of the angular velocity (i.e., rotational speed of the crankshaft), which can be measured using for example a tachometer. The processing circuit 210 may receive signals from the one or more measurement apparatuses (e.g., measurement apparatus 230) and determine various exercise performance parameters (e.g., energy or power output, resistance level, calories burned, etc.), which may be stored in memory (e.g., memory 210) and/or displayed via the user interface 102.

In some embodiments, the upper and lower moment-producing mechanisms 90 and 92 of exercise machine 100 may be resiliently coupled to one another such that force applied to the crank shaft via one of the moment-producing mechanisms versus the other may be determined. A resilient coupling is generally a coupling which may deform (e.g., bend, stretch, deflect, compress) under loads typical for normal use and is able to recoil or spring back substantially into its original shape, configuration, or position after deforming (e.g., bending, stretching, deflecting, or being compressed), for example as is typical for components such as springs or other compliant members (e.g., a compliant material such as rubber). The terms compliant and resilient may be used interchangeably herein. In one example, and as described, the crank arms 128 may be rigidly coupled to the crank shaft 125 to cause the crank shaft 125 to rotate responsive to movement of the pedals 132. On the other hand, the output member of the upper moment-producing mechanism 90 (e.g., disk 142 of one of the left or right upper linkages 90) may be resiliently coupled to the crank shaft 125 thereby enabling some relative movement (e.g., slip) between the disk 142 and the crank shaft 125 when load from the upper moment-producing mechanism 90 is being applied to the crank shaft 125. The relative movement or slip may be temporary, e.g., while load is being applied to each of the two resiliently coupled components or assemblies, and the relative displacement may be removed (e.g., due to the resilience of the coupling) in the absence of applied loads.

Figure 9:
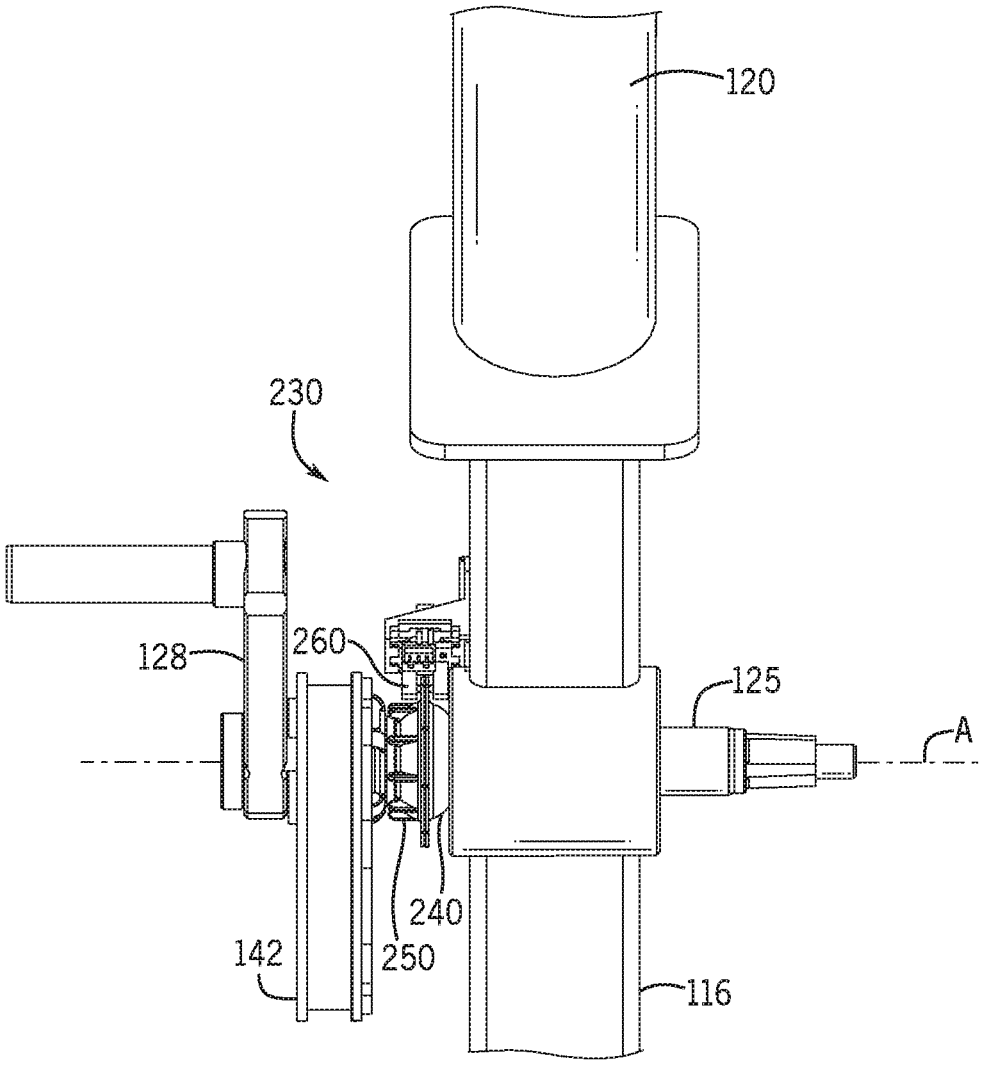
FIG. 9 is a view of a measurement apparatus for an exercise machine such as the machine in FIG. 1

In some embodiments, the processing circuit 210 of the energy tracking system 200 may be communicatively coupled to a measurement apparatus 230, which may be operable to generate signals indicative of relative movement of the upper and lower moment-producing mechanisms 90 and 92, respectively, as will be further described. The measurement apparatus 230 may be operatively coupled to one or more moving components of the exercise machine 100. For example, as shown in FIG. 9, components of the measurement apparatus 230 may be coupled to the crank shaft 125, to the eccentrically mounted disk 142, and the frame (e.g., upright brace 116) to generate signals indicative of relative angular displacement between a rotating component (e.g., a link or other rotating member, such as the virtual crank arm defined by the eccentrically mounted disk 142) of the upper moment-producing mechanism 90 relative and a rotating component (e.g., crank arm 128) of the lower moment-producing mechanism 92.

The measurement apparatus 230 may be implemented using an optical sensing component 260 in conjunction with a pair of concentric code wheels 240 and 250. For example, as shown in FIGS. 9 and 10, the measurement apparatus 230 may include an optical sensing component 260 which includes a light emitter (e.g., an LED) in one of the sensor supports 262-1 and a light detector (e.g., a photo sensor) in the other sensor support 262-2. The light emitter and sensor are arranged on the supports facing one another such that light emitted by the light emitter can be detected by the light detector. The two supports 262-1 and 262-2 and thus the light emitter and light detector are positioned on opposite sides of the pair of concentrically arranged and rotatable coupled code wheels (e.g., first wheel 240 and second wheel 250). One of the code wheels (e.g., first code wheel 240) may be rigidly coupled to the crank shaft 125 such that it rotates synchronously with the crankshaft. As such, the angular position and velocity of one of the code wheels (e.g., first code wheel 240) corresponds to the angular position and velocity of the crank shaft 125. As described, the crank shaft 125 is rigidly coupled to the crank arm 128, thus the code wheel 240 rotates also synchronously with rotation of the crank arm 128, e.g., responsive to force applied via the lower moment-producing mechanism 92. Thus, the force applied to the crank shaft 125 via the crank arm 128, and thus via the lower moment-producing mechanism 92, can be determined by tracking the angular position and/or velocity of the first code wheel.

The other code wheel (e.g., second code wheel 250) may be rigidly coupled to the virtual crank arm 142*a*, in this case rigidly coupled to the disk 142 which defines the virtual crank arm 142*a*. The disk 142 rotates eccentrically about the axis A of the crank shaft 125. The code wheel 250 may be coaxially arranged at the axis A such that the code wheel 250 rotates about axis A synchronously with rotation of the disk 142, e.g., responsive to force applied via the upper moment-producing mechanism 90. Thus, the force applied to the crank shaft 125 via the virtual crank arm 142*a*, and thus via the upper moment-producing mechanism 90, can be determined by tracking the angular position and/or velocity of the second code wheel. As described, the upper and lower moment-producing mechanisms 90 and 92 may be resiliently coupled. For example, the upper and lower moment-producing mechanisms 90 and 92 may be resiliently coupled by a resilient coupling between at least one of the left or right crank arms 128 and the respective disk 142. This may result in a slight relative displacement (e.g., a shift or offset) between the crank arm 128 and the disk 142 and thus between the first and second code wheels 240 and 250. The slight relative displacement (e.g., a shift or offset) may be indicative of the difference in force/energy applied to either side of the resilient member. The energy tracking system 200 may be configured to detect this slight relative displacement (e.g., shift or offset) and thus determine relative input of force via the upper moment-producing mechanism 90 versus the lower moment producing mechanism 92.

Figure 13:
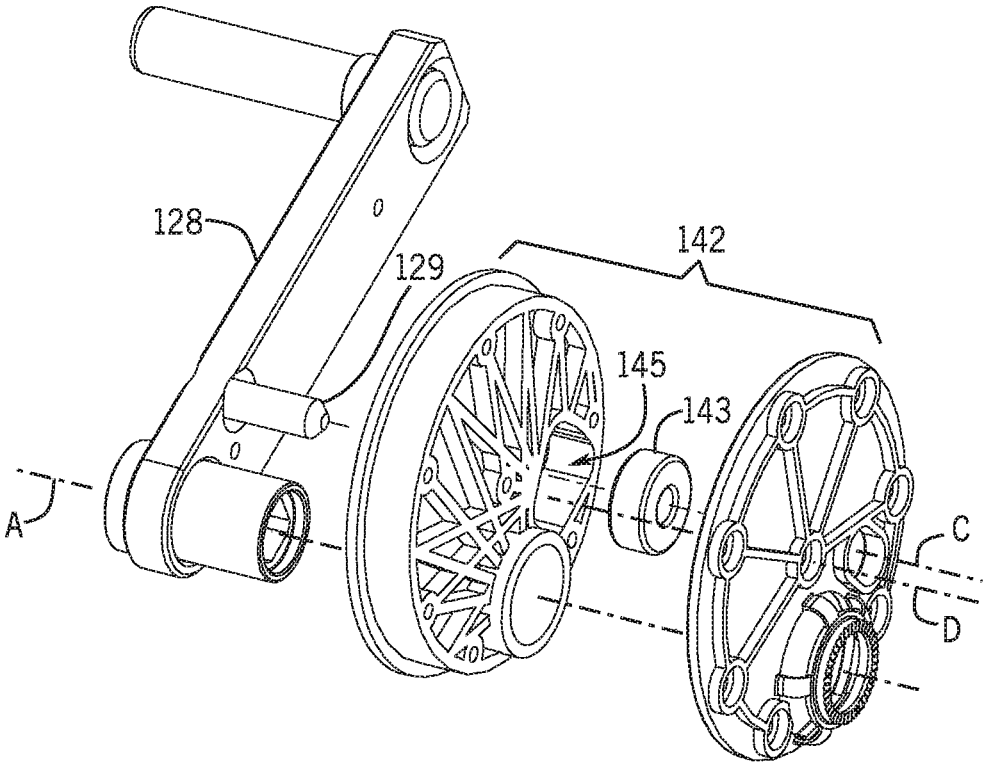
FIG. 13 is an exploded view of resiliently coupled rotating components of the exercise machine of FIG. 1 associated with operation of the measurement apparatus of FIG. 9.

Resilient coupling between the upper and lower moment-producing mechanisms 90 and 92 may be achieved for example in accordance with the embodiment shown in FIG. 13. The crank arm 128 may be pivotally coupled to the disk 142 using a pin 129 such that movement of either one of the upper and lower moment-producing mechanisms results in movement of the other one of the upper and lower moment-producing mechanisms. The pin 129 may be rigidly connected to the crank arm 128. The pin 129 may be rotatably received in an opening 145 in the disk 142. Movement of the crank arm 128 may be transmitted to the disk 142 and vice versa via the pin 129 bearing on the wall of the opening 145. The crank arm 128 may be resiliently pivotally coupled to the disk 142 for example, using a compliant member 143 (e.g., a rubber disk) positioned in the opening 145 between bearing surface of the pivotal coupling (e.g., between the pin 129 and walls of the opening 145). The compliant member 143 may compress in the direction of rotation when sufficient force is being transmitted from the crank arm 128 to the disk 142 or vice versa which may cause some relative movement (e.g., slip) between the crank arm 128 and the disk 142, and thus between the first and second code wheel.

Each of the code wheels 240 and 250 includes a plurality of slots or windows (e.g., first windows 242-1 through 242-9 of the first code wheel 240 and second windows 252-2 through 252-9 of the second code wheel 250). In some examples, the code wheels 240 and 250 may each include the same number of windows. In some examples, the first windows 242 of the code wheel 240 may have the same width $W_1$ and the width $W_2$ of the second windows 252 of the code wheel 250. The windows 242, 252 of each code wheel may be arranged radially along the peripheral portion of each code wheel at about the same radial distance from the center of each code wheel such that at least a portion of each window of the one of the code wheels overlaps a portion of a respective window of the other code wheel, to define an effective window of the pair of code wheels. That is, as shown e.g., in FIGS. 10 and 12, at least a portion of each of the first windows 242-1 through 242-9 overlaps a portion of a respective one of the second windows 252-1 through 252-9. In some example, the first and second windows 242, 252, respectively, may overlap only partially, as in the example in FIGS. 10 and 12, while remaining portions of the windows are blocked by the solid portions of the code wheels. For example, solid portions of the wheel 240 adjacent to each window 242 may block a portion of the opening of respective windows 252 and similarly, solid portions of the wheel 250 adjacent to each window 252 may block a portion of the opening of respective windows 242 defining an effective window of the pair of code wheels which has a width $W_E$. The width $W_E$ in this example is less than the widths $W_1$ and $W_2$ of the first and second windows. The widths $W_1$ and $W_2$ of the windows and the amount of overlap (e.g., the width $W_E$ of the effective window) may be selected based upon the stiffness of the resilient coupling between the upper and lower moment-producing mechanisms. For example, the widths $W_1$ and $W_2$ of the windows and the amount of overlap may be selected to allow an increase of the width $W_E$ to about the widths $W_1$ and $W_2$ or a decrease of the width $W_E$ to a non-zero minimum width upon the application of maximum expected force via the upper moment-producing mechanism.

Figure 12:
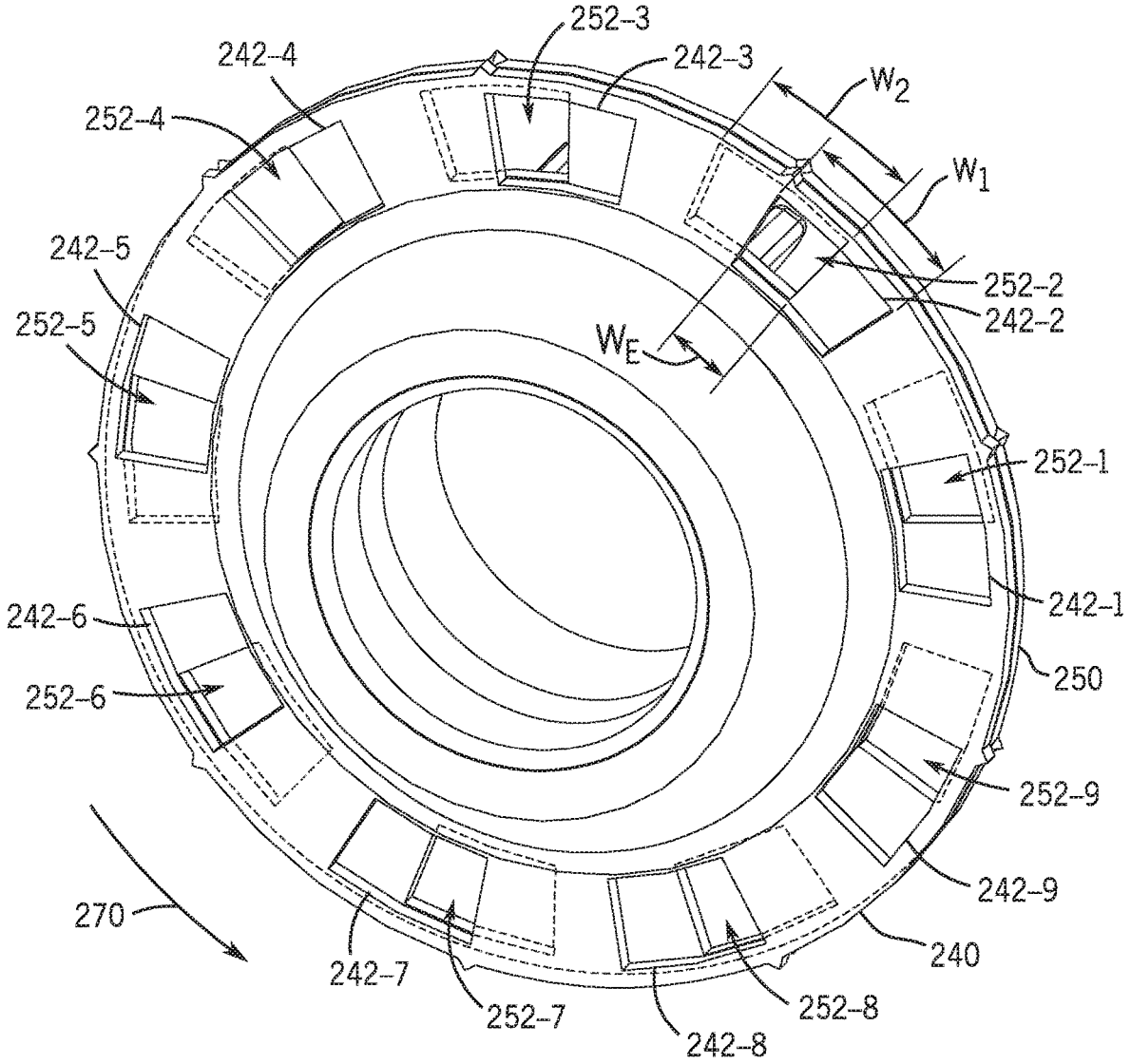
FIG. 12 is a perspective view of the code wheels of the measurement apparatus of FIG. 9.

In FIG. 12, the pair of concentrically arranged code wheels 240 and 250 is shown in a neutral alignment (e.g., as indicated by the alignment features 243 and 253 of the respective first and second code wheels 240 and 250). In this position, the width $W_E$ of the effective window defined by the pair of code wheels may be referred to as the neutral or starting width of the effective window. The neutral or starting width of the effective window may thus correspond to the width of the effective window in the absence of applied load to either of the two code wheels, or when load is being applied only to one of the code wheels. In the illustrated example in FIG. 12, the starting width is less than the widths $W_1$ and $W_2$ of the first and second windows, respectively. In other examples, the starting width may be substantially the same as the widths of the first and second windows (e.g., in a case where the windows are not offset but overlap substantially fully). In such examples, the relative displacement of the code wheels (e.g., shift or offset) may be determined by detecting (e.g., using the sensing component) a narrowing of the starting width of the effective window. In such examples, the direction of slip may be determined, for example, using a second radial array of encoding (e.g., slots) which may be slightly offset to allow the phase shift between the two arrays to be monitored in order to track direction of rotation of the wheels and consequently the direction of relative displacement of the wheels. The starting width of the effective window may be stored in memory 320 and retrieved by the processing circuit 210 for use in determining the amount of relative slip between the code wheels.

Figure 14A:
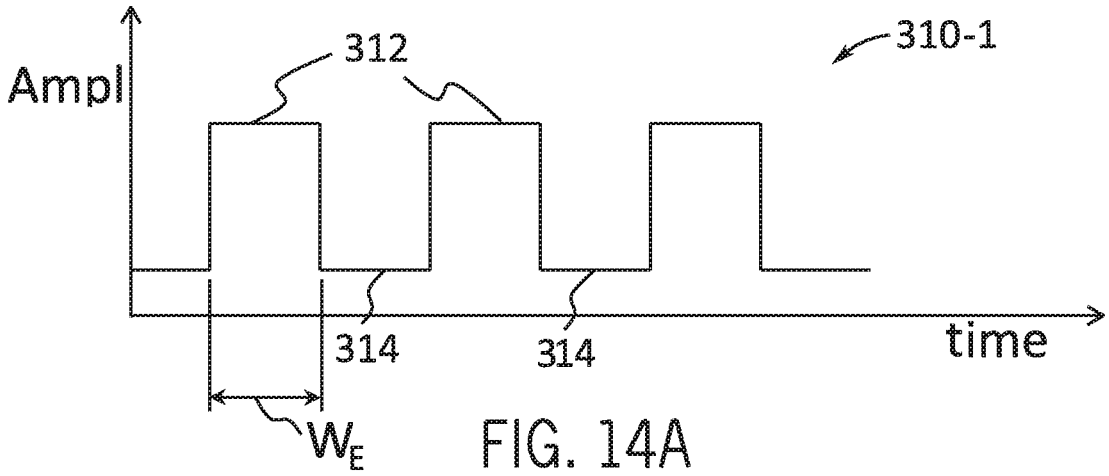
FIG. 14A-14C are waveforms illustrative of signal pulses produced by the measurement apparatus of FIG. 9.
Figure 14B:
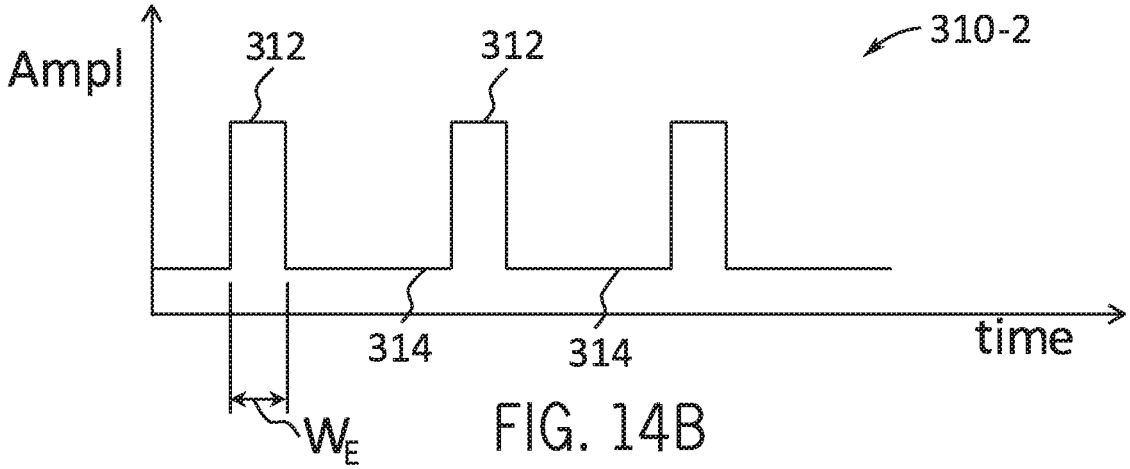

During use, e.g., when the crank shaft 125 is rotated only responsive to force applied by one of the moment-producing mechanism (e.g., the lower moment-producing mechanism 92), the sensing component 260 may produce a signal pattern having a generally rectangular waveform 310-1 as shown in FIG. 14A. The positive pulses 312 of the wave form 310-1 correspond to the periods of time when light is being detected by the light detector through the effective window defined by the pair of code wheels. The negative pulses 314 correspond to the periods of time when light is not being detected by the light detector (i.e., the periods of time when the light emitter is blocked by the solid portions of the code wheels between adjacent windows. The angular velocity (e.g., revolutions per unit time) may thus be determined from the frequency of the wave form and the total number of windows of the pair of code wheels. For example, if the detected frequency is 900 pulses per minute, the processing circuit 210 may determine that the angular velocity of a pair of code wheels having a total of 9 effective windows is 100 revolutions per minute.

The machine 100 may be configured such that, during use of the machine, the pair of code wheels remain in the neutral position (e.g., with the alignment features 243 and 253 substantially aligned) relative to one another if force is being applied via only one of the upper or lower moment-producing mechanisms 90, 92, typically via the lower moment-producing mechanisms 90 which is driven by the legs of the user. This may be achieved for example, by selecting the stiffness of the resilient coupling between the upper or lower moment-producing mechanisms 90, 92 such that the resilient coupling does not appreciably deform in the absence of force from both the upper and lower moment-producing mechanisms 90, 92. Thus, in some examples, the resilient coupling may be sufficiently stiff to prevent any appreciable compression, and thus any detectable slip, absent the application of force by both the upper and lower moment-producing mechanisms 90, 92. The energy tracking system 200 may be configured to detect variations from the neutral alignment, e.g., by detecting a change in the width $W_E$ of the effective window. Such variations from the neutral alignment may thus be indicative of slip and thus indicative of the application of force via the upper moment producing mechanism.

Figure 14C:
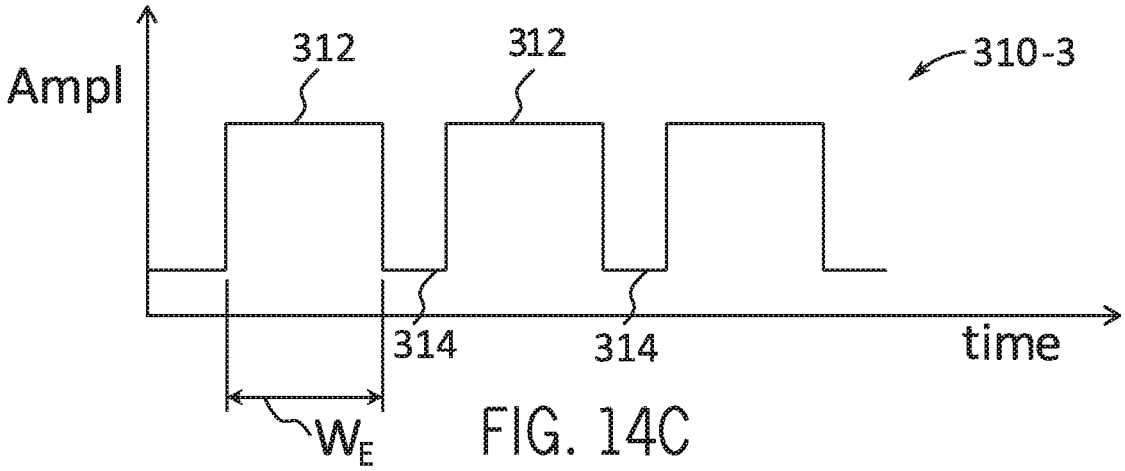

Returning back to the illustrated examples, the width of a positive pulse 312 may correspond to the width of the effective window. Thus, when force is applied via the upper moment-producing mechanism in a direction causing the wheel to slip in the same direction as the rotation direction (e.g., direction 270) of the crank shaft, the width of the effective window may decrease, and correspondingly the period of the positive pulse 312 may decrease as shown in the wave form 310-2 FIG. 14B. Conversely, if force is applied via the upper moment-producing mechanism in a direction causing the wheel to slip in the opposite direction as the rotation direction of the crank shaft (e.g., direction 271 in FIG. 10), the width of the effective window may increase, and correspondingly the period of the positive pulse may increase as shown in FIG. 14C. Thus, the narrowing or widening of the effective window may be indicative of force being applied to the crank shaft via the upper moment-producing mechanism (e.g., positive or negative to the force applied by the lower moment-producing mechanism). Thus, the narrowing or widening of the effective window can be used to determine whether positive or negative work is being done by the upper body of the user.

When no appreciable force is being applied by the upper moment-producing mechanism (e.g., responsive to upper body work by the user such as when the user's arms are free riding on work produced by the user's lower body), the pair of code wheels may remain in the neutral alignment. The energy tracking system 200 may be configured to display an indication of zero or nominal work being performed by the user's upper body. The narrowing of the effective window may be indicative of additional force being applied by the upper moment-producing mechanism (e.g., additional to just allowing the arm links to free ride on the force applied by the lower moment-producing mechanism). In such instances, the energy tracking system 200 may be configured to display an indication of positive work being performed by the user's upper body. Depending on the amount of narrowing of the effective window, the energy tracking system 200 may be configured to determine and display an indication of the relative amount of additional work being performed by the user's upper body. A widening of the effective window may be indicative of resistive force being applied by the upper moment-producing mechanism (e.g., against the work being done by the lower moment-producing mechanism). In such instances, the energy tracking system 200 may be configured to display an indication of negative work being performed by the user's upper body and/or the amount of negative work based on the amount of narrowing of the effective window. In some examples, the energy tracking system 200 may be additionally or alternatively configured to display an instruction to modify movement of the upper body (e.g., to increase the speed or effort exerted by the upper body). The instruction may be displayed until the energy tracking system 200 detects zero or nominal work being performed by the user's upper body, or in some cases until the energy tracking system 200 detects positive work being performed by the user's upper body.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A measurement apparatus for an exercise machine including a frame and at least one moment-producing assembly supported by the frame, the measurement apparatus comprising:

an optical sensing component supported by the frame; and a pair of code wheels supported by the frame and operatively arranged with the optical sensing component for measuring power exerted by a user responsive to manipulation of the at least one moment-producing assembly, wherein the pair of code wheels comprises:

a first code wheel having a plurality of first windows; and a second code wheel having a plurality of second windows, the second code wheel operatively arranged in relation to the first code wheel such that individual ones of the first windows at least partially overlap respective ones of the second windows of the second code wheel to define an effective window through both the first and second code wheel, and wherein the second code wheel is movably coupled to the first code wheel to vary a width of the effective window; and wherein the optical sensing component is operatively arranged in relation to the pair of code wheels to detect variations in the width of the effective window.

2. The measurement apparatus of claim 1, wherein the second code wheel is coaxially rotatably coupled to the first code wheel.

3. The measurement apparatus of claim 1, wherein the first and second code wheels are arranged such that the first windows of the first code wheel overlap only partially the second windows of the second code wheel.

4. The measurement apparatus of claim 1, wherein the optical sensing component is configured to generate a signal indicative of the width of the effective windows of the pair of code wheels.

5. The measurement apparatus of claim 4, wherein the optical sensing component is operatively coupled with a processing circuit configured to determine a change in the width of the effective window.

6. The measurement apparatus of claim 4, wherein the optical sensing component is configured to generate a signal having a rectangular wave form comprising a plurality of positive pulses, each having duration indicative of the width of the effective window.

7. The measurement apparatus of claim 1, wherein the measurement apparatus is operatively coupled to a processor configured to determine power generated responsive to input from the at least one moment-producing assembly based on the variations in the width of the effective window.

8. The measurement apparatus of claim 1, wherein:

the first code wheel is configured to be coupled to a first rotational component of a first moment-producing apparatus of the exercise machine such that the first code wheel rotates synchronously with the first rotational component;

the second code wheel is configured to be coupled to a second rotational component of a second moment-producing apparatus of the exercise machine such that it rotates synchronously with the second rotational component; and the optical sensing component is configured to detect a difference in the rotation of the first and second code wheels by variations in the width of the effective window.

9. The measurement apparatus of claim 8, wherein the measurement apparatus is operatively coupled to a processor configured to determine, based on the detected difference in the rotation of the first and second code wheels, relative power generated responsive to input from the first moment-producing apparatus versus the second moment-producing apparatus.

10. The measurement apparatus of claim 9, wherein the processor is part of an energy tracking system configured to display information about the relative power generated responsive to input from the first moment-producing apparatus versus the second moment-producing apparatus.

11. An exercise machine comprising the measurement apparatus of claim 8 and a resistance mechanism driven by a crankshaft, wherein the first code wheel is operatively associated with a crank arm coupling the first moment-producing apparatus to the crankshaft, and wherein the second code is operatively associated with a virtual crank arm coupling the second moment-producing apparatus to the crankshaft.

12. The exercise machine comprising the measurement apparatus of claim 11, wherein the crank arm and the virtual crank arm are resiliently coupled to one another.

13. The exercise machine of claim 11, wherein the first moment-producing apparatus includes an upper moment-producing mechanism comprising left and right upper linkages operatively connected to opposite sides of the crankshaft, each of the left and right upper linkages operatively connected to left and right handles to cause the crankshaft to rotate responsive to movement of either of the left or the right handle.

14. The exercise machine of claim 13, wherein each of the left and right upper linkages includes an upper reciprocating member and a disk pivotally coupled to the upper reciprocating member and eccentrically coupled to the crankshaft, and wherein the virtual crank arm is defined between an axis of the disk and the crank axis.

15. The exercise machine of claim 11, wherein the second moment-producing apparatus includes a lower moment-producing mechanism comprising left and right lower linkages operatively connected to opposite sides of the crankshaft, each of the left and right lower linkages operatively connected to respective left and right pedals to cause the crankshaft to rotate responsive to movement of either of the left or the right pedal.

16. The exercise machine of claim 15, wherein each of the left and right lower linkages includes a lower reciprocating member pivotally coupled to the crank arm.

17. The exercise machine of claim 11, wherein the resistance mechanism includes a flywheel with a magnetic brake.

* * * * *